US007351902B1

(12) United States Patent
Sikra

(10) Patent No.: US 7,351,902 B1
(45) Date of Patent: Apr. 1, 2008

(54) CYMBALS REMOTE ACTUATION DETACHMENT MEANS

(75) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 11/541,293

(22) Filed: Sep. 28, 2006

(51) Int. Cl.
*G10D 13/02* (2006.01)

(52) U.S. Cl. ..... 84/422.1

(58) Field of Classification Search ..... 84/422.1, 84/422.2, 422.3
See application file for complete search history.

(56) References Cited

U.S. PATENT DOCUMENTS 5,267,500 A * 12/1993 Lombardi ..... 84/402

* cited by examiner

*Primary Examiner*—Kimberly Lockett
(74) *Attorney, Agent, or Firm*—William W. Haefliger

(57) ABSTRACT

For use in actuating a cymbal, there being an upright support stand and an upright rod associated with the stand and operatively attached to a cymbal to move it substantially vertically as the rod is moved substantially vertically, in response to operation of a foot activated pedal unit, the combination comprising an enclosure associated with the stand and being openable, the rod projecting downwardly to a rod end connection in the enclosure, the rod end connection movable longitudinally up and down relative to the enclosure, an endwise movable cable projecting upwardly to a cable end connection in the enclosure, the cable end connection having releasable coupling to the rod end connection to be longitudinally movable up and down therewith, thereby moving the rod up and down, and a cable guide carried by the enclosure to enable longitudinal release of said coupling and lateral removal of the cable end connection from the enclosure upon opening thereof.

17 Claims, 6 Drawing Sheets

CYMBALS REMOTE ACTUATION DETACHMENT MEANS

BACKGROUND OF THE INVENTION

This invention relates generally to cymbal and/or so-called hi-hat apparatus, and more particularly to remote actuation of such equipment, as via foot actuated pedal units.

There is need for easily usable and maintainable apparatus of the above type. This need becomes acute where a flexible cable is employed between a foot actuated pedal unit and a cymbal or hi-hat actuating rod to be moved up and down by the pedal unit. Simple, effective mounting structure for the cable in relation to its operation of the rod is needed, and allowing ready detachment of the cable from the rod, as during transport and/or cleaning of the equipment. The cable and its sheath also are typically kept in lubricated condition to allow easy (low friction) actuation of the cymbal or hi-hat, in response to foot pedal actuation; however, repeated sliding of the cable back and forth in its sheath can produce wear and resultant particle formation and build-up, tending to clog the clearances between the cable and its sheath, and increasing friction between the cable and sheath. There is need to keep the cable free of such build-up. Operation of the cymbal or hi-hat then becomes undesirably difficult.

SUMMARY OF THE INVENTION

It is a major object of the invention to provide improved apparatus meeting the above needs. Basically, the improved apparatus is usable in conjunction with an upright support stand and an upright rod associated with the stand, the rod attached to the cymbal (or hi-hat) to move it vertically, in response to operation of a foot actuated pedal unit remote from the stand. The apparatus in this environment then comprises:

a) an enclosure associated with the stand and being openable, b) said rod projecting downwardly to a rod end connection in the enclosure, the rod end connection movable longitudinally up and down relative to the enclosure, c) an endwise movable cable projecting upwardly to a cable end connection in the enclosure, the cable end connection having releasable coupling to the rod end connection to be longitudinally movable up and down therewith, and thereby moving the rod up and down, d) and a cable guide carried by the enclosure to enable release of said coupling and relative lateral removal of the cable end connection from the enclosure upon opening thereof.

It is another object to provide a guide in the form of a linear bearing, the enclosure having a movable side wall holding the guide in position relative to the enclosure and the cable. As will be seen, the enclosure may define a laterally extending recess in which the guide is removably retained by the side wall, for lateral removal from the recess, with the cable, when the side wall is laterally moved away form the enclosure.

A further object is to provide one of the connections defining a slot and the other end connection defines an insert receivable in the slot, at least one of the slot and insert having lateral width which substantially exceeds its thickness dimension, and including an adjustable holder exerting laterally directed force against one edge defined by the insert to jam an opposite edge of the insert against an interior wall defined by the slot; for positively locking the insert to said interior wall, establishing the coupling. The insert may advantageously have disc configuration, with lateral cross dimensional width which substantially exceeds its thickness. In this regard, the insert may be defined by the cable end connection, and the slot defined by the rod end connection. This enables the cable end connection to bear upwardly against the rod end connection to transfer upward lifting force directly to the rod end connection and then to rod, the disc shape preventing rotation relative to the rod end connection, and consequent loosening. Also, the disc configuration of the cable end connection defines a vertical plane so that said disc one edge and opposite edge extend laterally substantially oppositely, in jammed condition, establishing coupling stability and rigidity during the rapid up and down movement of cymbals activation and clasping.

These and other objects and advantages of the invention, as well as the details of an illustrative embodiment, will be more fully understood from the following specification and drawings, in which:

DRAWING DESCRIPTION

DETAILED DESCRIPTION

Figure 1:
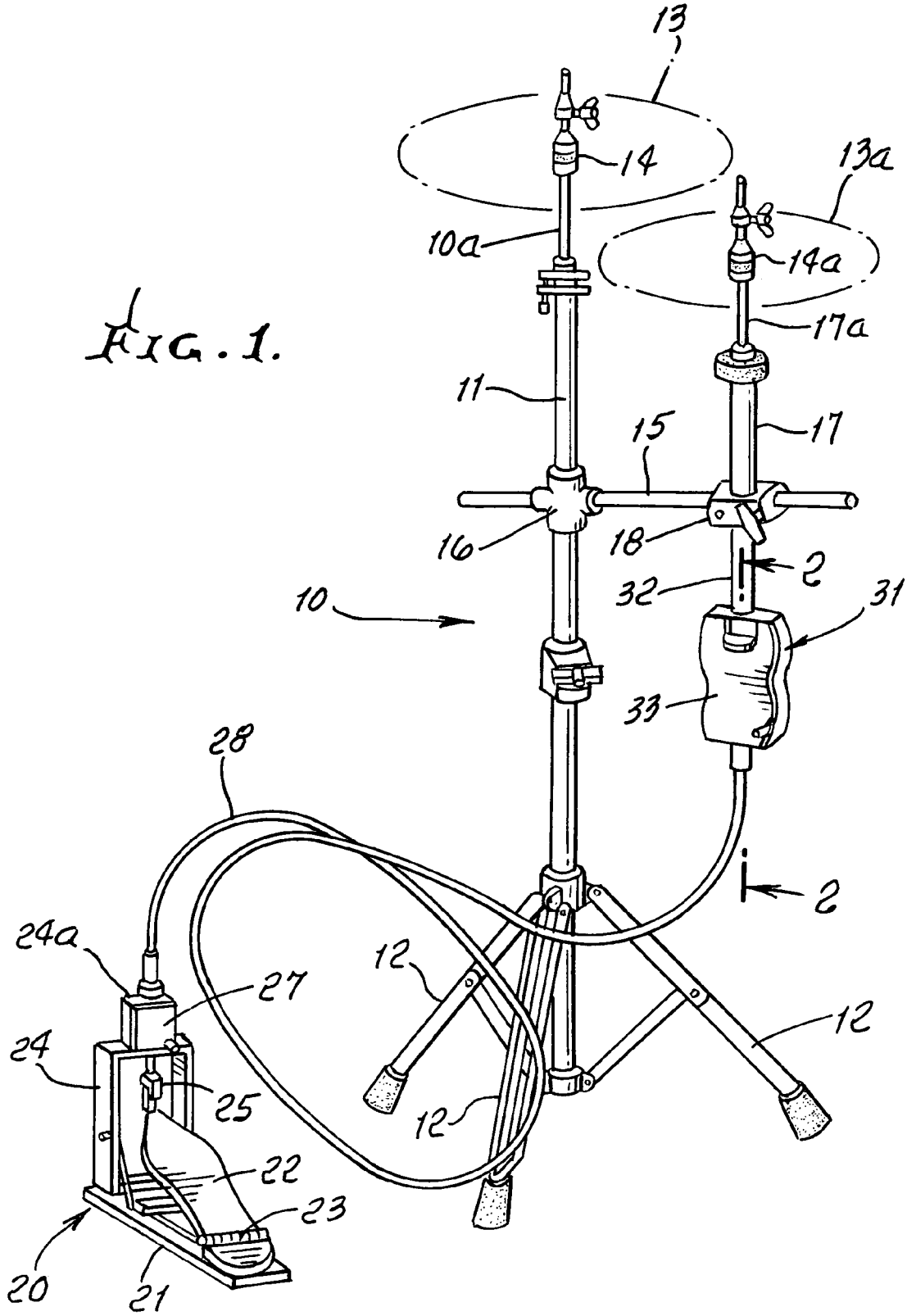
FIG. 1 is a perspective view of apparatus incorporating the invention.

In FIG. 1, a cymbal or hi-hat stand 10 includes an upright post 11, supported by three legs 12, collapsible inwardly from their expanded positions, as shown, for transportation. A cymbal (or hi-hat) is shown schematically at 13, carried by structure 14 on the post upper structure 10*a*. A lateral bar 15 is carried by the post 11 at 16, and supports upright member 17, via a removable connection 18. Another cymbal (or hi-hat) is shown schematically at 13*a*, and is carried by structure 14*a* on the member 17 element 17*a*. Structures 14 and 14*a* may be connected to lower cymbals 13 and 13*a*, to be moved rapidly upwardly to strike upper cymbals. Typically structures 14 and 14*a* appear in U.S. Pat. No. 5,121,665.

Also shown in FIG. 1 is a drummer's foot actuated pedal unit 20 located remotely from the stand 10, and positionable as desired by the drummer. Unit 20 includes a bottom plate 21, a pedal 22, pedal hinge 23 connected to the plate, an upright frame 24, and an attachment 25 on the pedal to be moved up and down as the pedal is foot deflected. Attachment 25 may include a chain connected at its lower end to the pedal, and connected at its upper end to a slider movable up and down in a housing 27.

A flexible cable 28 has its lower end attached to the slider, and projects within a protective tubular sheath 29, the lower end 29*a* of which is attached to the housing 27. The housing 27 attaches to the transverse part 24*a* of frame 24. Accordingly, as the pedal 22 is moved up and down, the cable 28 moves endwise oppositely in and relative to the sheath. Viscous lubricant is applied to the space between the cable and its sheath to reduce sliding friction therebetween; however, such lubrication can become desirably lessened due to build up of wear particles, dirt, etc., and congealed lubricant, in the clearance spaces between the cable and sheath.

As better shown in FIGS. 2-12, as well as in FIG. 1, an enclosure or housing 31 is associated with stand 10, and may be advantageously attached to bar 15, as by a suspending upright tube 32 connected to 18. The box-like enclosure is generally rectangular, having an openable front wall 33, back wall 33*a*, top and bottom walls 34 and 34*a*, and left and right side walls 35 and 35*a*. Walls 34 and 34*a* are curved as shown, to facilitate hand gripping during cable and rod connection and disconnection.

Cymbals rod 17*a* projects downwardly through 17 and into the housing 31 via upper bearing 40 to terminate at end connection or retainer 41. Likewise, the cable 28 projects upwardly into the housing, via lower guide or centering unit 42, to terminate at end connection 43. Each end connection is movable longitudinally up and down relation to the enclosure; also, the cable end connection has releasable coupling (seen in FIGS. 2 and 3) to the rod end connection for moving the rod up and down.

It will be seen that one of said end connections (such as the rod end connection) defines a slot 45, and the other end connection (such as the cable end connection) defines an insert 46 receivable in the slot so as to be blocked against relative rotation of these elements about the cable or rod axis 47, i.e. against loosening from their received and locked intercoupled positioning. Insert 46 is attached to cable 28, which is endwise movable in a linear bearing 46*b* defined by 46.

For this purpose, the slot and insert have lateral width which substantially exceeds their thickness dimensions, and the insert may preferably have substantially disc shape. An adjustable holder, such as a set screw 48 in 41, is tightened, or tightenable to exert laterally directed force against one edge 46*a* of the insert disc, to jam the insert opposite edge 46*b* against interior wall 49 of the slot formed by the rod end connection 41, for positively locking the insert to that interior wall, i.e., against axial loosening as well as relative rotation. It will be noted that axial loosening of the coupled elements is also prevented by the substantial absence of pulling apart force, since the weight of the rod and cymbal pushes down at 50 on the disc during foot uplift from the pedal unit; and force transmitted to the cable during foot down load on the pedal unit is directly transmitted upwardly at 50 to the cymbals rod lower end connection.

In addition, the disc configuration of the cable end connection defines a vertical plane so that said disc one edge and its opposite edge at 46*a* and 46*b* extend laterally substantially oppositely, in jammed condition, establishing coupling stability and rigidity during the rapid up and down movement of cymbals activation and clasping.

Figure 3:
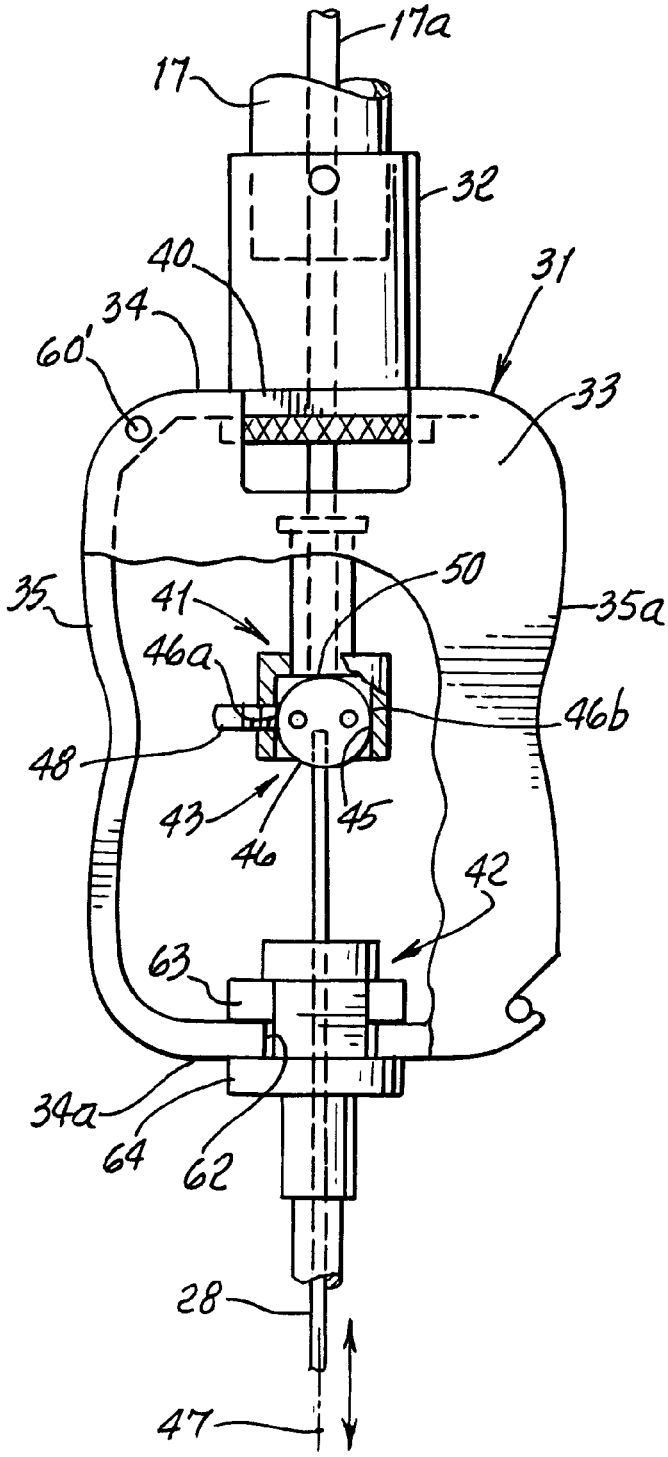
FIG. 3 is an elevation taken on lines 3-3 of FIG. 2.
Figure 2:
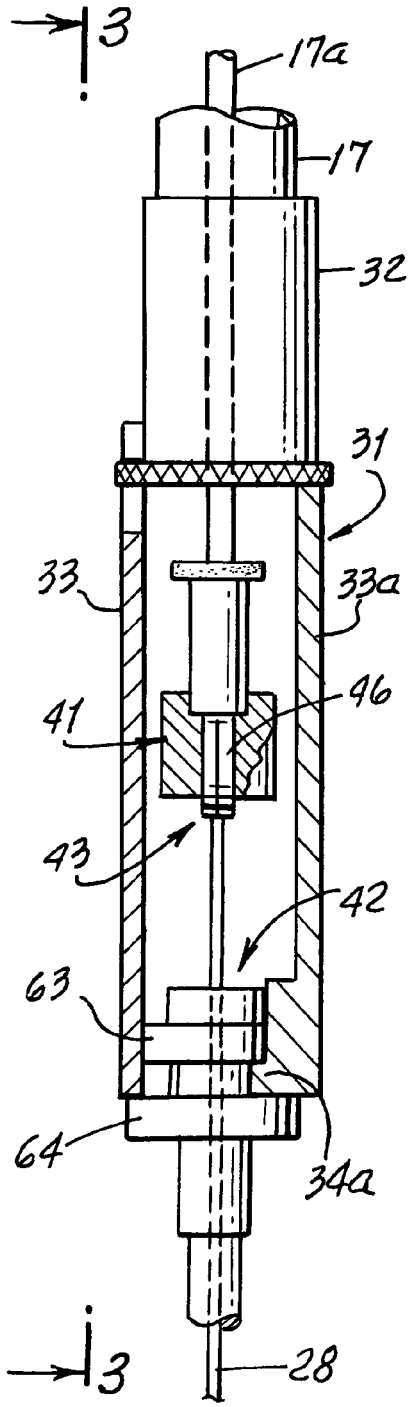
FIG. 2 is an enlarged section taken on lines 2-2 of FIG. 1.
Figure 5:
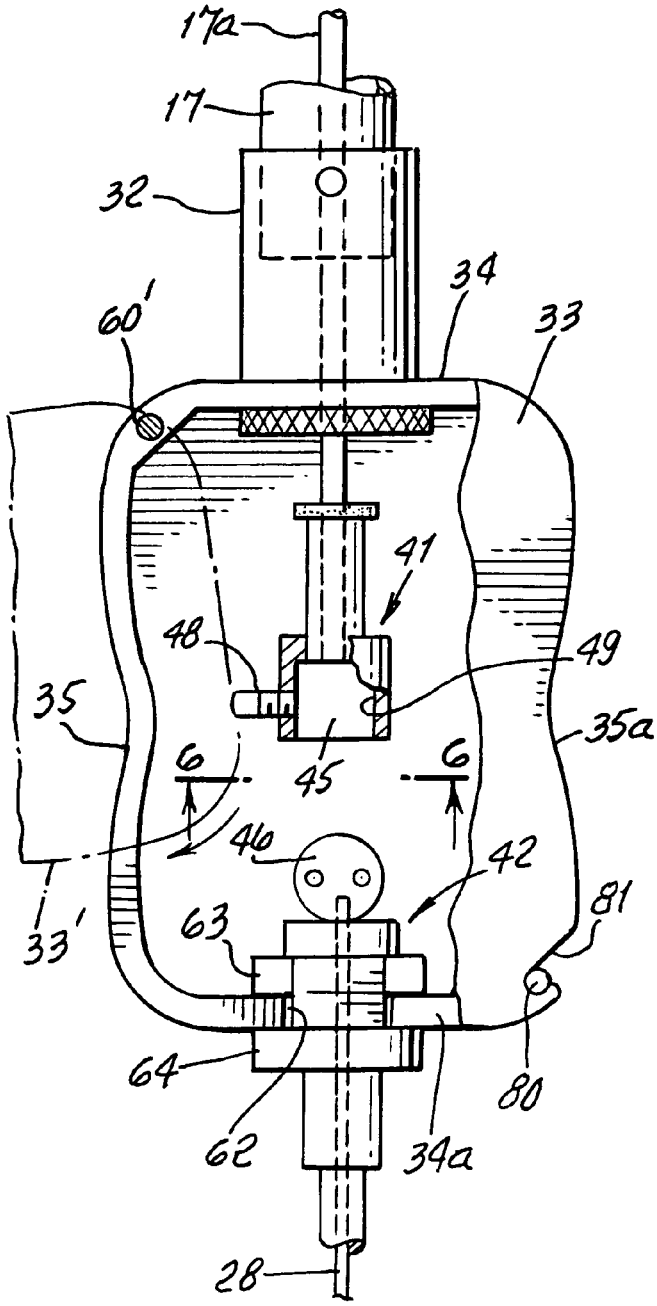
FIG. 5 is a view like FIG. 3, showing the disconnected condition of the rod and cable end connections.
Figure 4:
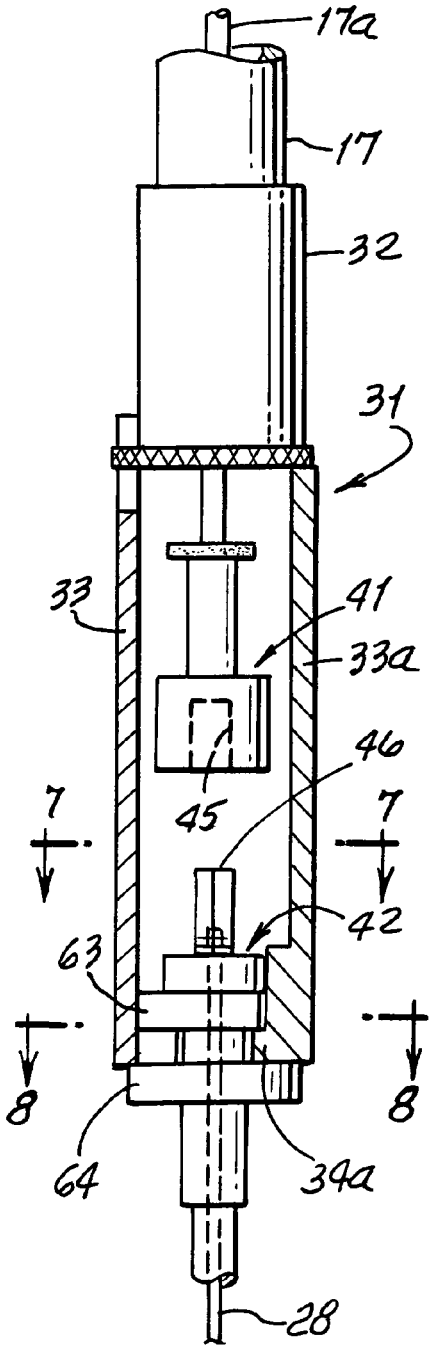
FIG. 4 is a view like FIG. 2, but showing a disconnected condition of the rod and cable end connections.
Figure 6:
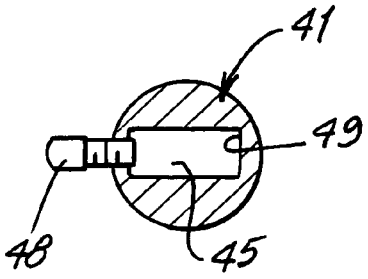
FIG. 6 is a bottom plan view taken on lines 6-6 of FIG. 3.
Figure 9:
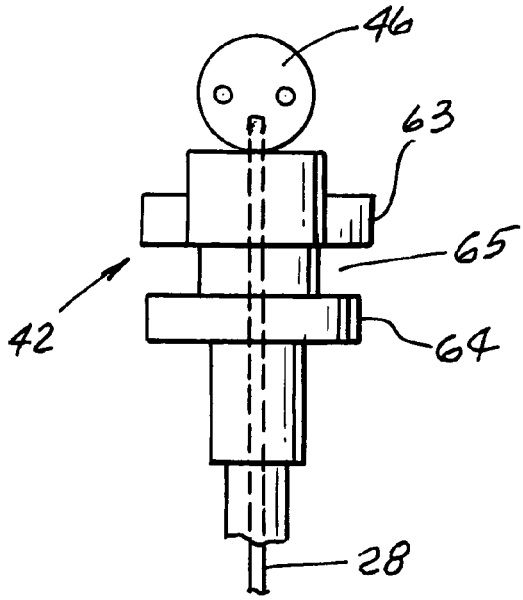
FIG. 9 is a view taken on lines 9-9 of FIG. 7.
Figure 7:
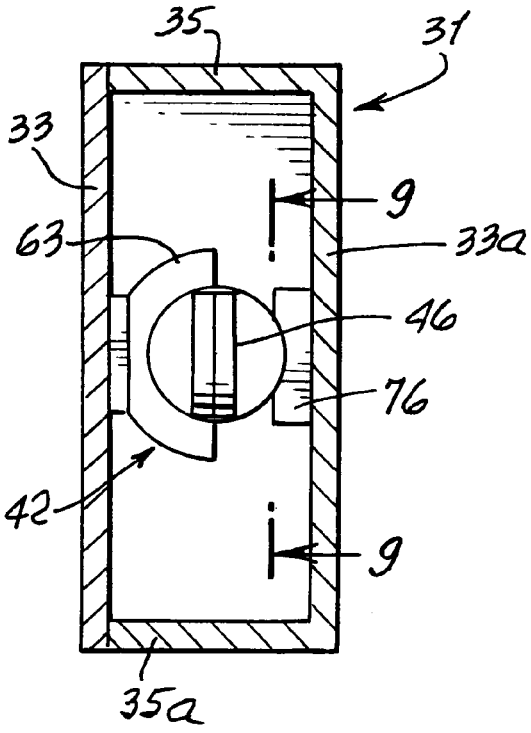
FIG. 7 is a section taken on lines 7-7 of FIG. 4.
Figure 8:
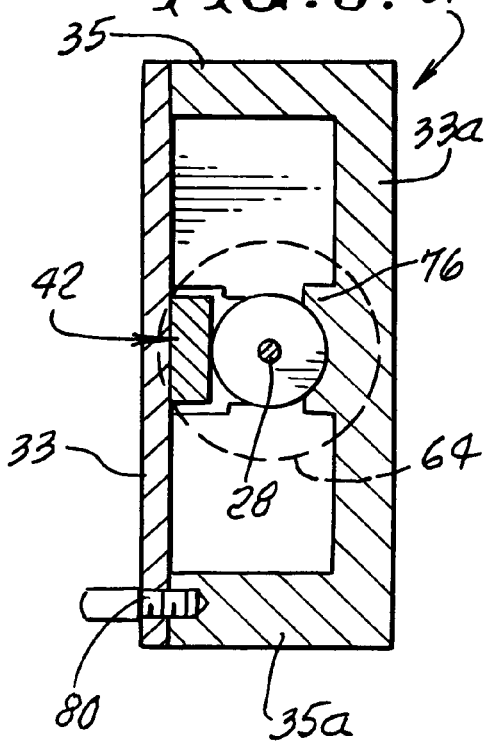
FIG. 8 is a section taken on lines 8-8 of FIG. 4.
Figure 10:
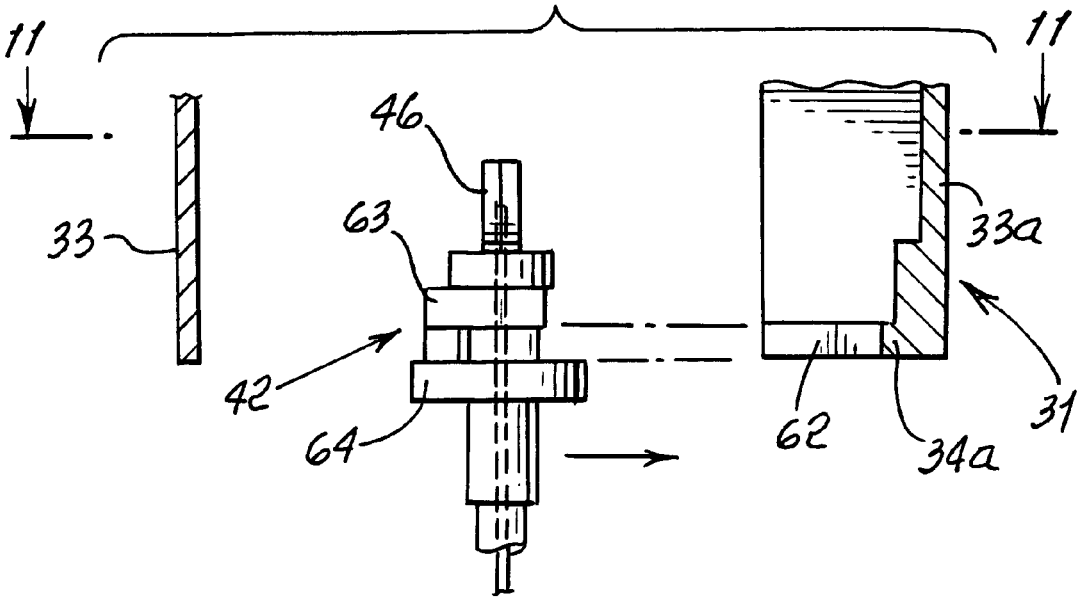
FIG. 10 is an exploded view of elements of FIG. 4.
Figure 11:
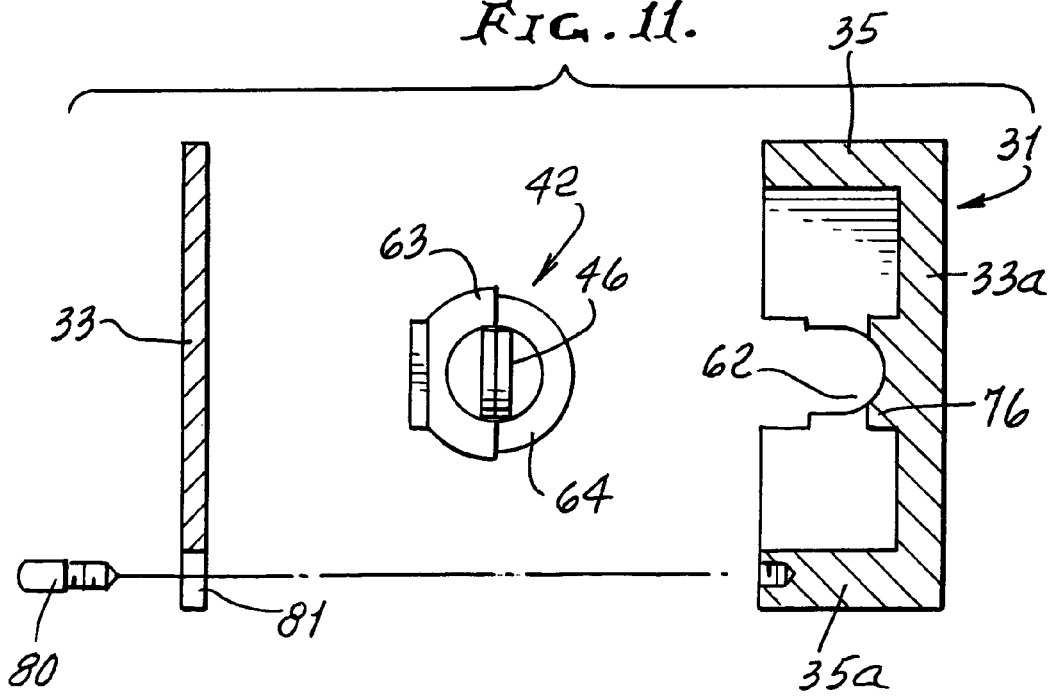
FIG. 11 is an end view of elements of FIG. 10.

In addition, the movable side wall, as for example swingable side wall 33 of the enclosure holds at 75 the removable cable guide 42 in position, relative to the enclosure and cable, in cymbals playing position, as seen in FIGS. 2 and 3. A pivot for the wall or door is shown at 60', to allow door opening for cable and guide removal in the disconnected configuration of the end connection as seen in FIGS. 4 and 5. In that configuration, with door 33 swung upwardly parallel to the plane of disc 46, to broken line position 33' seen in FIG. 5, the guide 42 may be simply lifted from a recess 62 formed by lower end wall 34*a* of the enclosure, as seen in FIGS. 10 and 11. The guide is shown to have spaced flanges 63 and 64 that embrace recess bottom wall structure 76 for endwise retention of the guide; and the space 65 between the flanges fits the recess structure 76, in installed position as seen in FIG. 5. Side wall 33 is held in closed position by interfit of a stud 80 and recess 81.

Figure 12:
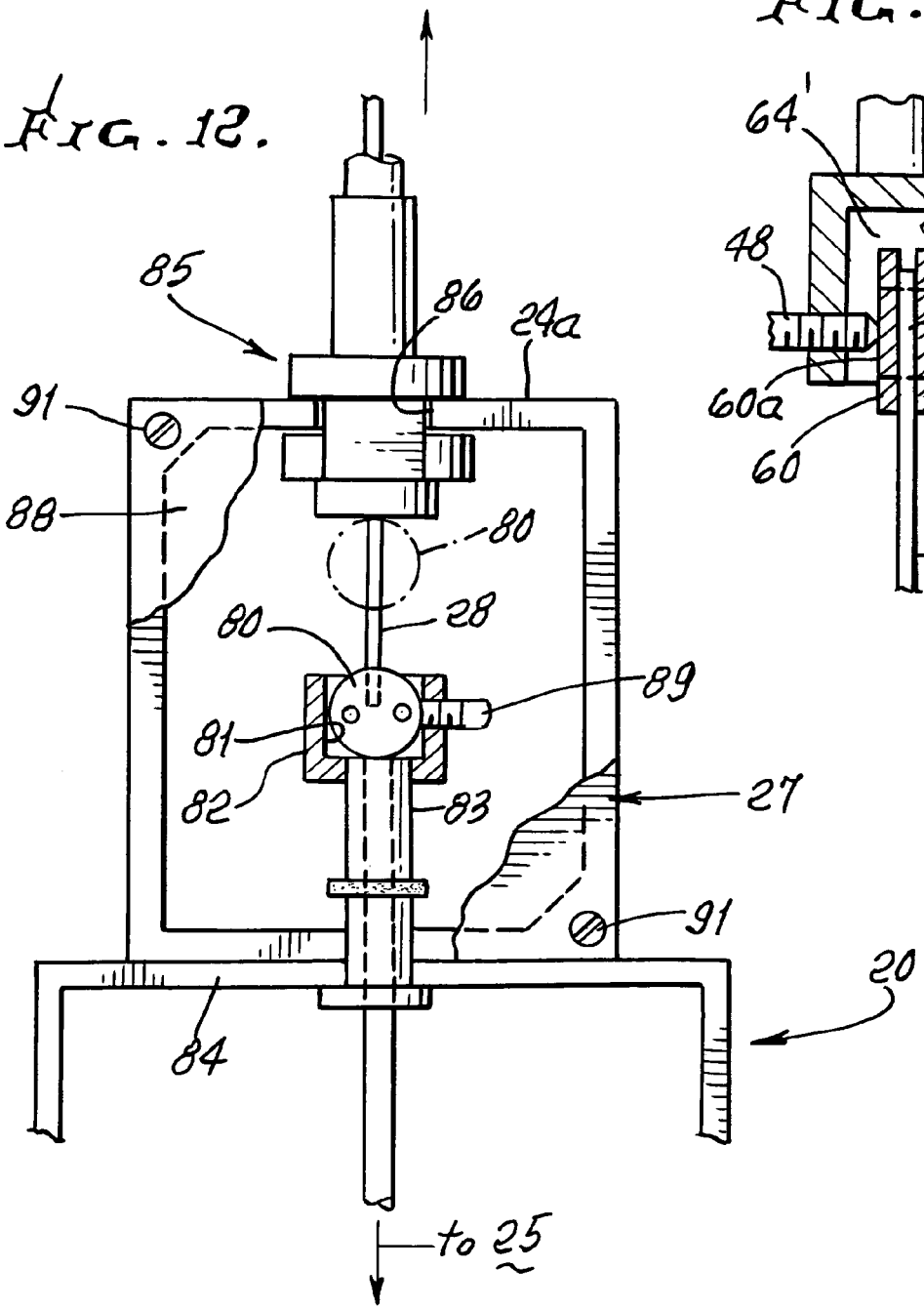
FIG. 12 is a view of an assembly similar to FIG. 3, showing cable and rod end connection in disconnected condition.

In FIG. 12, the lower end of the cable 28 is connected to a disc shaped insert 80 receivable in an opening 81 in a retainer 82 attached at 83 to frame 84 of pedal unit 20. A set screw 89 attaches 80 to 82, as in FIG. 3. Centering unit 85 for cable 28 is receivable in a slot 86 in housing 27. A cover 88 of housing 27 encloses 85 and 82 in position, and when removed, as by removal of fasteners 91, the cable and insert 80 can be removed, as during transport.

Figure 13:
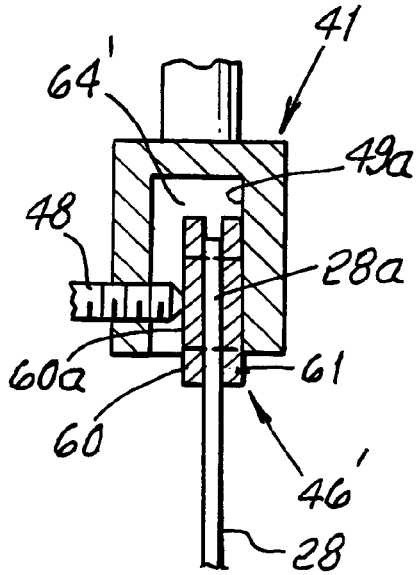
FIG. 13 is a fragmentary view showing a modification of cable retention.

In FIG. 13, elements the same as those in FIG. 3 bear the same numerals. Also, insert 46' comprises two connected plates 60 and 61 between which the cable end portion 28*a* is retained. Set screw 48, when tightened, exerts laterally directed force against face 60*a* of plate 60. That force is transmitted to plate 61 to jam it against side wall 49*a* of the slot 64' formed by rod end connector 41; also such force compresses cable end portion 28*a* to enhance retention of the cable to the plates. The plates are shown in the form of discs, as before, acting to center the cable end portion 28*a* in alignment with rod 17*a*, preventing loosening during rapid cymbal actuation. This mode of connection may be used at the upper and lower locations, as in FIGS. 3 and 12.

Accordingly, an easily and efficiently installed interconnection is provided, enabling rapid assembly, and disassembly, as for transport.

I claim:

1. For use in actuating a cymbal, there being an upright support stand and an upright rod associated with the stand and operatively attached to a cymbal to move it substantially vertically as the rod is moved substantially vertically, in response to operation of a foot activated pedal unit, the combination comprising:

a) an enclosure associated with the stand and being openable, b) said rod projecting downwardly to a rod end connection in the enclosure, the rod end connection movable longitudinally up and down relative to the enclosure, c) an endwise movable cable projecting upwardly to a cable end connection in the enclosure, the cable end connection having releasable coupling to the rod end connection to be longitudinally movable up and down therewith, thereby moving the rod up and down, d) and a cable guide carried by the enclosure to enable longitudinal release of said coupling and lateral removal of the cable end connection from the enclosure upon opening thereof.

2. The combination of claim 1 wherein said guide provides a linear bearing for cable longitudinal movement.

3. The combination of claim 1 wherein the enclosure has a movable side wall holding said guide in position relative to the enclosure and the cable.

4. The combination of claim 3 wherein said side wall is pivotally connected to the enclosure.

5. The combination of claim 3 wherein the enclosure defines a laterally extending recess in which said guide is removably retained by the side wall, for lateral removal from the recess, with the cable, when the side wall is laterally moved away from the enclosure interior.

6. The combination of claim 1 wherein one of said end connections defines a slot and the other end connection defines an insert receivable in the slot, at least one of the slot and insert having lateral width which substantially exceeds its thickness dimension, and including an adjustable holder exerting laterally directed force against a surface defined by insert to jam an opposite surface of the insert against an interior wall defined by the slot, for positively locking the insert to said interior wall, establishing said coupling.

7. The combination of claim 6 wherein the insert has disc configuration, with lateral cross dimensional width which substantially exceeds its thickness.

8. The combination of claim 7 wherein the insert is defined by the cable end connection, and the slot is defined by the rod end connection.

9. The combination of claim 6 wherein the insert is defined by the cable end connection and bears upwardly against the rod end connection to transfer upward lifting force directly to the rod end connection and rod.

10. The combination of claim 9 wherein the insert has disc configuration, with lateral cross dimensional width which substantially exceeds its thickness, and the disc configuration defines a vertical plane so that said disc one edge and opposite edge extend laterally substantially oppositely, in jammed condition, establishing coupling stability and rigidity during the rapid up and down movement of cymbals activation and clasping.

11. For use in actuating a cymbal, there being an upright support stand and an upright rod associated with the stand and operatively attached to a cymbal to move it substantially vertically as the rod is moved substantially vertically, in response to operation of a foot activated pedal unit, the combination comprising:

a) a support associated with the stand and being accessible, b) said rod projecting downwardly to a rod end connection in the support, the rod end connection movable longitudinally up and down relative to the support, c) an endwise movable cable projecting upwardly to a cable end connection at the support, the cable end connection having releasable coupling to the rod end connection to be longitudinally movable up and down therewith, thereby moving the rod up and down, d) a cable guide carried by the support to enable release of said coupling and lateral removal of the cable end connection from the support upon accessing thereof, e) and wherein one of said end connections defines a slot and the other end connection defines an insert receivable in the slot, and including an adjustable holder exerting laterally directed force against a surface defined by insert to jam an opposite surface of the insert against an interior wall defined by the slot, for positively locking the insert to said interior wall, establishing said coupling.

12. The combination of claim 11 wherein one of said end connections defines a slot and the other end connection defines an insert receivable in the slot, and including an adjustable holder exerting laterally directed force against a surface defined by the insert to jam an opposite surface of the insert against an interior wall defined by the slot, for positively locking the insert to said interior wall, establishing said coupling.

13. The combination of claim 11 wherein said insert has plate configuration, and said holder exerts force against a face defined by the insert.

14. The combination of claim 11 wherein the insert comprises two plates, and the holder exerts force against one of the plates which exerts compression against a cable portion between the plates.

15. In Combination a) an elongated cable having opposite ends and connections at said ends, b) upper and lower retainers at upper and lower locations for releasable coupling to said respective end connections c) a percussion instrument operatively connected to said upper retainer, d) a foot operated pedal operatively connected to said lower retainer, e) and upper and lower guide structures for guiding endwise movement of said cable at said upper and lower locations, f) said opposite end connections have plate configuration, there being adjustable set screws for transmitting force to said upper and lower plates to releasably couple them to the retainers, g) and wherein one of said end connections defines a slot and the other end connection defines an insert receivable in the slot, and including an adjustable holder exerting laterally directed force against a surface defined by the insert to jam an opposite surface of the insert against an interior wall defined by the slot, for positively locking the insert to said interior wall, establishing said coupling.

16. The combination of claim 15 including mounting structure at said upper and lower locations, for releasably holding said guiding structures in predetermined positions.

17. The combination of claim 11 wherein said opposite end connections have plate configuration, there being adjustable set screws for transmitting force to said upper and lower plates to releasably couple them to the retainers.

* * * * *